US006128839A

United States Patent [19]

Debourg et al.

[11] Patent Number: 6,128,839

[45] Date of Patent: Oct. 10, 2000

[54] IRON AND IRONING METHOD WITH TEXTILE ADJUVANT DISPENSING

[75] Inventors: Jean-Pierre Debourg, Lyons; Dominique Gelus, Eyzin; Eliette Rosell-Laclau, Lyons, all of France

[73] Assignee: SEB S.A., Ecully, France

[21] Appl. No.: 09/341,873

[22] PCT Filed: Nov. 26, 1998

[86] PCT No.: PCT/FR98/02535

§ 371 Date: Jul. 19, 1999

§ 102(e) Date: Jul. 19, 1999

[87] PCT Pub. No.: WO99/27176

PCT Pub. Date: Jun. 3, 1999

[30] Foreign Application Priority Data

Nov. 26, 1997 [FR] France ..... 97 15112

[51] Int. Cl.[7] ..... D06F 75/18

[52] U.S. Cl. ..... 38/77.8

[58] Field of Search ..... 38/77.1, 77.5, 38/77.8, 77.82

[56] References Cited

U.S. PATENT DOCUMENTS 5,010,664 4/1991 Sakano et al. ..... 38/77.8
5,138,778 8/1992 Brandolini ..... 38/77.5
5,507,108 4/1996 Bruggink et al. ..... 38/77.8
5,526,595 6/1996 Daulsim et al. .

FOREIGN PATENT DOCUMENTS 554 166 8/1993 European Pat. Off. .
2632331 12/1989 France ..... 38/77.8
2 705 975 12/1994 France .

*Primary Examiner*—Ismael Izaguirre
*Attorney, Agent, or Firm*—Pillsbury Madison & Sutro

[57] ABSTRACT

The invention concerns an iron and an ironing method. The iron comprises a heating soleplate (2), a reservoir (15) designed to contain a textile adjuvant and a device for dispensing (11–13) the adjuvant. The iron comprises a diluting device (7, 12, 14, 18) comprising an adjuvant-free water supply system (7), the diluting device being connected to the adjuvant reservoir and designed to produce a diluted adjuvant solution before dispensing. Preferably, the iron comprises an evaporating device (4–10) fed by the water supply system.

11 Claims, 2 Drawing Sheets

IRON AND IRONING METHOD WITH TEXTILE ADJUVANT DISPENSING

This application is the national phase of international application PCT/FR98/02535 filed Nov. 26, 1998 which designated the U.S.

TECHNICAL FIELD

The present invention relates to an iron and ironing process, with distribution of a textile adjuvant.

PRIOR ART

Irons have known significant improvements such as the addition of devices for moistening the linen, by spraying water with the aid of an integrated sprayer, and/or with means for producing steam.

There are known products facilitating ironing, for example by improving sliding of the iron, and products improving the behavior of the fabrics, for example in order to soften them or in order to improve the appearance. The means for distributing these products onto the fabric are essentially bottles filled with treating products in liquid form: soluble oils, suspensions or latex. These bottles are either under gas pressure, or supplied with a manual pump in order to permit distribution by spraying on a fabric to be ironed. However, the utilization of bottles requires the user to put down her iron each time since in order to impregnate the fabric, she must grasp the bottle.

This difficulty is resolved by systems integrated into the iron and comprising a pump, described for example in French patent 2,705,975, which requires a reservoir separate from the steam reservoir, reserved for the textile treating product.

One shortcoming of such systems is that the supplemental reservoir assigned to the active product occupies a great amount of space, at the expense of the water reservoir for steaming, which reduces the capacity of the iron. Moreover, the presence of two reservoirs inevitably leads to filling errors, and the filling of the water reservoir for steaming with an active product, even very diluted, can lead to a very poor functioning of the iron with ejection of impurities through all of the steam holes.

There are also known devices described for example in French patent 2,686,629 where the active product is distributed at the same time as the steam. These devices for distribution with the steam have unfortunately the drawback of not permitting the utilization of a varied range of active products, these having to be among others those which do not distill and which are not destroyed by steam.

SUMMARY OF THE INVENTION

The invention has as an object an iron permitting a distribution of a textile adjuvant without having the preceding drawbacks of known devices, and thus rendering possible the utilization of a varied range of active products, permitting a satisfactory capacity for the iron and convenience of use with minimum risks of handling errors.

The invention equally concerns an ironing method with distribution of a textile adjuvant, convenient and easy to use.

The invention is thus applied to an iron comprising a heating soleplate, a reservoir intended to contain a textile adjuvant and a device for distributing the adjuvant.

According to the invention, the iron comprises means for diluting the adjuvant comprising an adjuvant-free water supply system, these diluting means being connected to the adjuvant reservoir and intended to produce a diluted solution of the adjuvant before distribution.

Thus, the adjuvant reservoir can contain the adjuvant in concentrated form, the dilution means permitting to obtain during operation the desired concentration of the distributed product. One advantage for an iron is that the adjuvant reservoir can be of small capacity. Thus, in the case of an iron comprising a water reservoir for steaming, the capacity of the iron is not adversely affected, in contrast to existing devices.

Integration of an adjuvant reservoir into the iron permits simplification of the distribution of the adjuvant by a user. In addition, in the case where the iron comprises a water reservoir for steaming, the risks of confusion during filling are considerably reduced by the fact that the capacities of the water reservoir and of the adjuvant reservoir are very different. Any risks of error will be eliminated if use is made in the adjuvant reservoir of pre-filled cassettes.

At the interior of the adjuvant reservoir, the concentrated active product is in a first embodiment in liquid form, and in a second embodiment in solid form. The adjuvant-free water supply system comprises, as for itself, in a first embodiment a water reservoir and in a second embodiment an integrated water inlet.

The device for distribution of the adjuvant is advantageously a spraying device. In other embodiments, it consists of a system for delivering jets under pressure or flow of liquid by gravity.

Preferably, the iron comprises a steam device fed by the water supply system.

Thus, the same system serves at the same time to dilute the adjuvant and to furnish the steam. This characteristic enhances the simplicity of utilization of the iron with steaming and permits an economical fabrication and use.

In an advantageous manner, the adjuvant being liquid, the dilution means comprise a mixing chamber connected to the adjuvant distribution device and means for supplying the mixing chamber with water from the supply system and with adjuvant from the adjuvant reservoir.

The presence of such a chamber improves the control of dilution.

In this embodiment with a dilution chamber, the means for supplying the mixing chamber comprise advantageously first and second pumping systems respectively drawing water and adjuvant into the mixing chamber, these pumping systems having an average relative flow rate in a ratio of the desired dilution.

Thus, the diluting means are activated in a reliable manner and the dilution ratio is perfectly controlled.

The two pumping systems of the means for supplying consist of two pumps, or of two bodies of a single pump.

It is then advantageous for the adjuvant reservoir to include a spout opening to the exterior of the iron, intended to avoid an excessively low pressure in the adjuvant reservoir.

According to another embodiment of the iron with a mixing chamber, the mixing is effectuated by back flow and not by aspiration. In an embodiment without a mixing chamber, the water is conducted directly into the adjuvant reservoir and it provokes the desired dilution.

In another embodiment without a mixing chamber, the adjuvant being liquid, the diluting means comprise a pump which draws water from the supply system and adjuvant from the adjuvant reservoir and in which there is produced a mixing of the water and the adjuvant, and a tap which permits metering of the suctioning of the adjuvant, and to thus obtain an average relative pumping flow rate of water and adjuvant in a desired dilution ratio.

This latter embodiment is particularly economical.

Advantageously, the adjuvant reservoir consists of a removable cassette.

Such a cassette is preferably of small volume and disposable after use. It also facilitates the utilization of the iron according to the invention and avoids all possible confusion in the case where the iron comprises a reservoir for water for steaming.

In a first embodiment of the water supply system, this latter comprises an adjuvant-free water reservoir.

In a second embodiment of the water supply system, this comprises a water inlet.

The water supply system, with water reservoir or water inlet, is advantageously that provided for steaming in the case where the iron is a steam iron.

Preferably, the adjuvant is in a form selected from among a solution, an emulsion, a suspension, a latex and a soluble solid.

In the case where the adjuvant is in solid form, a current of water passes through the adjuvant reservoir during each adjuvant distribution operation and is loaded to the maximum concentration permitted by the laws of solubility. Preferably, the diluting means of the iron then permit the solution obtained as with a liquid to be diluted, to the desired level.

The invention has equally for its object an ironing method in which a textile adjuvant is distributed on a surface to the iron.

According to the invention, the adjuvant is preliminarily disposed in concentrated form in an adjuvant reservoir and during the ironing the adjuvant contained in the adjuvant reservoir is mixed with water obtained from an adjuvant-free water supply system, in a manner to produce a diluted solution of the adjuvant, and this solution is distributed onto the surface to be ironed.

BRIEF DESCRIPION OF THE DRAWINGS

The invention will be illustrated without being in any way limited by the detailed description of embodiments given by way of examples and represented on the attached figures, on which:

On the two Figures, the same elements are designated by the same references.

BEST MANNER OF CARRYING OUT THE INVENTION

Figure 1:
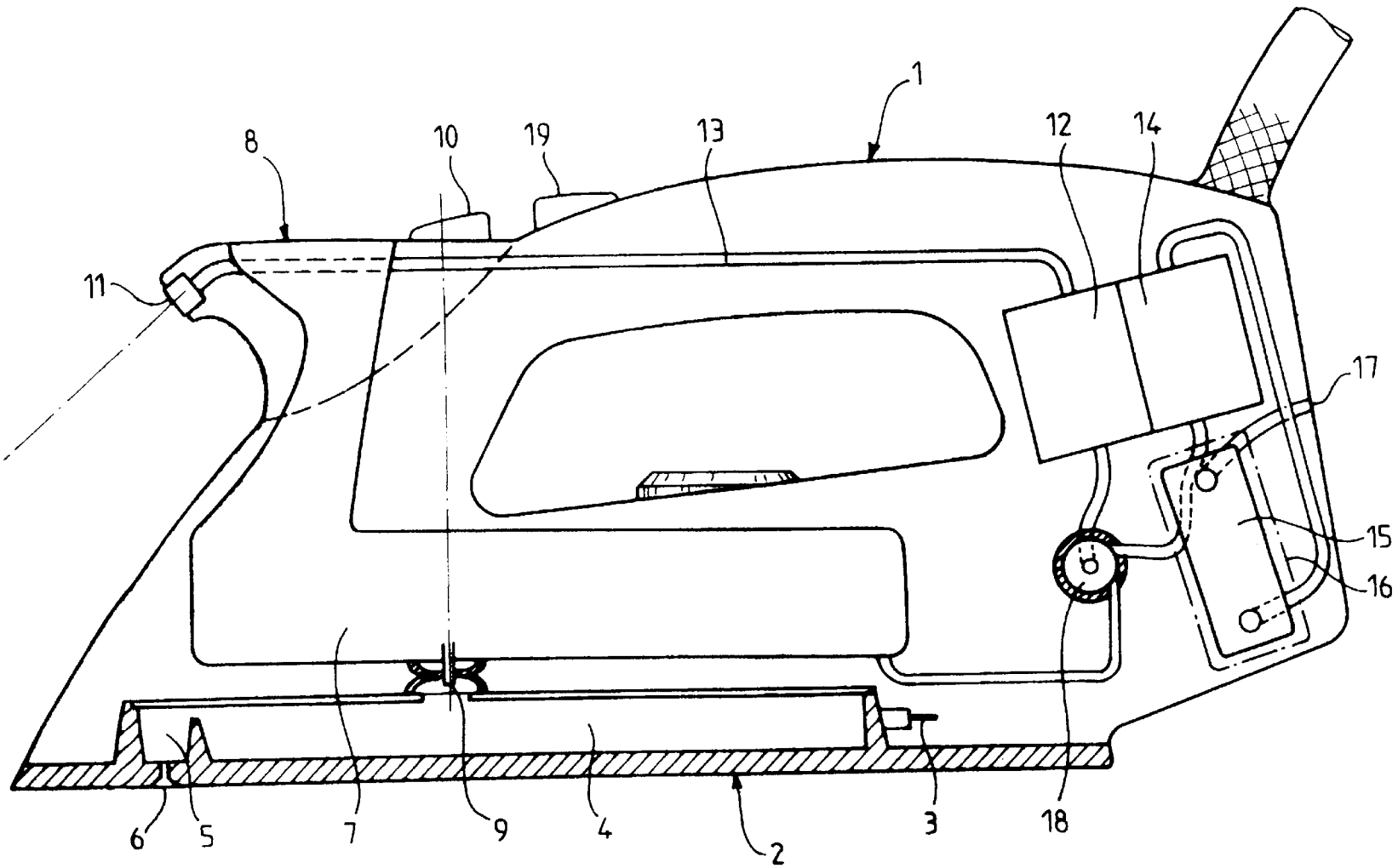
FIG. 1 represents a longitudinal cross-section of a first embodiment of an iron according to the invention.

An iron according to the invention, shown in FIG. 1, is a steam iron comprising a body 1. This body 1 forming a handle, supports soleplate 2 electrically heated by a sheathed heating element one extremity 3 of which is illustrated. Soleplate 2 is provided with a steam chamber 4 and a chamber 5 for distributing steam toward steam orifices such as 6. An integrated reservoir 7 has a filling opening 8 and is in communication with steam chamber 4 via a flow regulating valve 9 whose control 10 is accessible to the user, in the usual manner.

The iron comprises a protrusion in front, this form permitting a good orientation of a spray nozzle 11 in the direction of the laundry to be ironed. This nozzle 11 is advantageously located relatively high, at least at the level of gripping in order to maintain a satisfactory distance with respect to the fabric and with an average incidence angle which does not exceed 60° with respect to the vertical. Preferably, it is of the flat jet type, the plane of the jet being perpendicular to the median longitudinal plane of the iron. Nozzle 11 is supplied with a diluted active product by an electric pump 12 via a conduit 13. Pump 12 preferably furnishes a pressure near or greater than 1.5 bars. A second pump 14 suctions the concentrated active product contained in a reservoir 15. This reservoir is preferably a removable cassette housed in a compartment 16. A spout 17 opening to the exterior of the iron permits the suctioning without too much of a pressure drop in the cassette. An annular chamber 18 of small volume, presents a tangential inlet of the concentrated product in the vicinity of pump 14 and a tangential entry of water from reservoir 7. The axial outlet is connected to the inlet of pump 12 supplying nozzle 11.

The two pumps 12 and 14 are miniature pumps which can be identical. During spraying, pump 12 operates continuously while pump 14 functions with a duty cycle less than one. Chamber 18 must then have a sufficient volume to permit homogenizing the mixture during an operating period of pump 14. A control 19 permits spraying and electronics, not shown, create the operating cycle of pump 14. Optionally, another control permits not using the product and spraying only water by halting pump 14.

By way of example the flow rate of supply nozzle 11 is 80 g/mn and that of pump 14 is 4 g/mn on average and is obtained by a flow of 100 g/mn during 4/100 of an operating period. The operating time of pump 14 is 10 ms and the period is 250 ms. The capacity of chamber 18 is of the order of the main flow during several periods or around 0.6 to 2 $cm^3$. In this manner, the flow from nozzle 11 consists of a mixture of around 1/20 of concentrated product with water, but the duty cycle of pump 14 can be adjusted for any desired dilution. By way of example reservoir 15 has a volume of 15 $cm^3$ while reservoir 7 has a capacity of the order of 200 $cm^3$.

Figure 2:
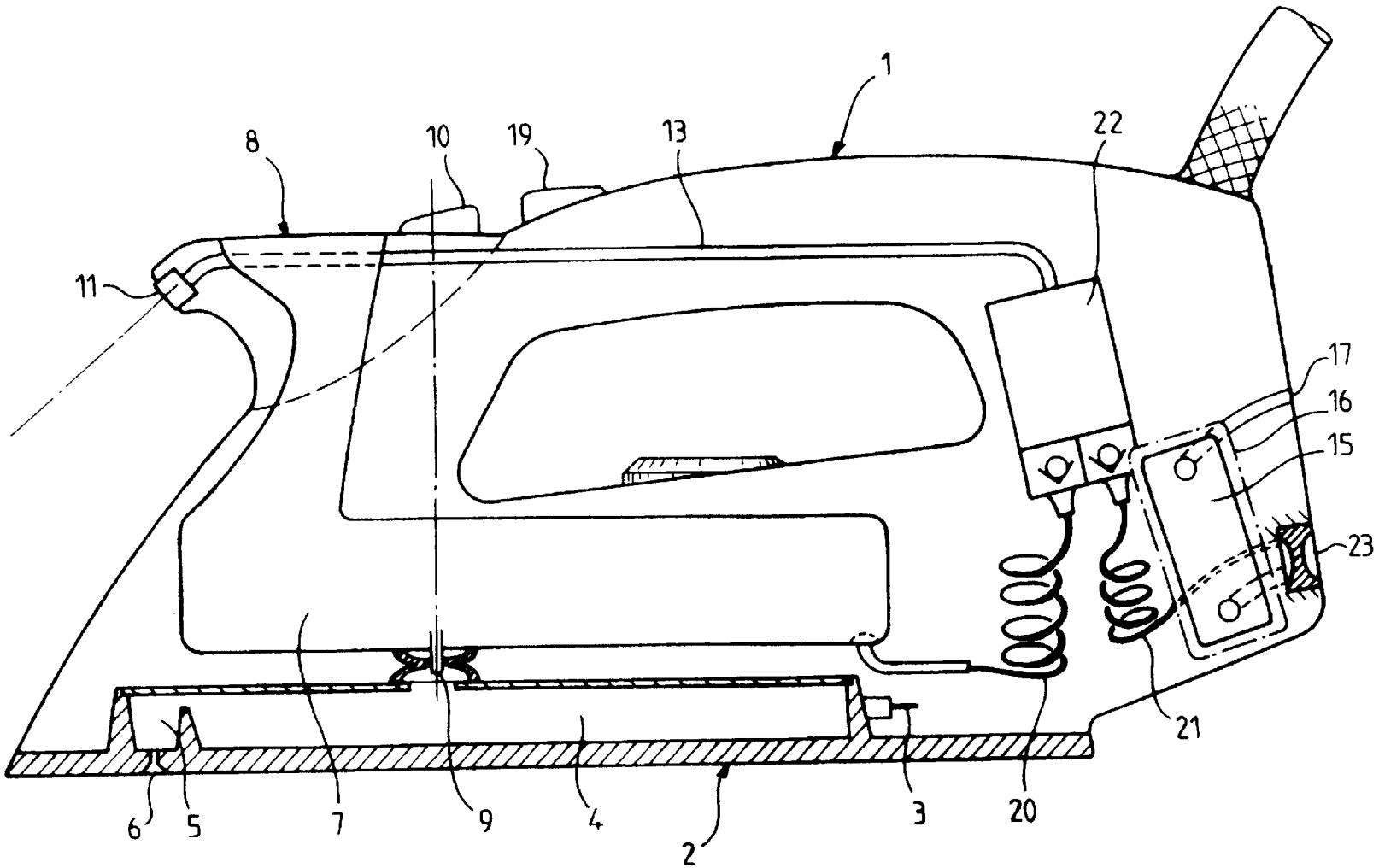
FIG. 2 represents a longitudinal cross-section of a second embodiment of an iron according to the invention.

In a second embodiment, shown in FIG. 2, nozzle 11 is supplied with diluted active product by a single pump 22 having two inlet valves. Pump 22 suctions water from reservoir 7 via a first capillary tube 20, and possibly a water treatment cartridge (not shown). Simultaneously, it suctions the treatment product from reservoir 15 via a second capillary tube 21 and a tap 23.

Tap 23 permits metering and controlling the suction flow of the concentrated active product contained in reservoir 15. Advantageously, it renders possible a complete interruption of suctioning of the treatment product, which permits the iron to distribute selectively via nozzle 11 the treatment product or simply water, as with an ordinary spray. The flow rate of concentrated product being very inferior to the flow rate of water, closing of tap 23 does not substantially affect the flow rate of the spray.

The two capillary tubes 20 and 21 and the tap 23 permit control of the respective flow rates and concentrated product. Capillary tube 20 creates a pressure drop at the entrance of pump 22 and capillary tube 21 is adapted to furnish the flow rate of the product as a function of its viscosity and of the vacuum pressure at the inlet.

In operation, water and adjuvant are suctioned simultaneously into pump 22 and are there mixed. Preferably, the concentrated product has a flow which is continuous and simultaneous with that of the water, in such a manner that the mixing is performed without difficulty in pump 22. One thus easily obtains dilutions in a ratio of 1/20.

POSSIBILITY OF INDUSTRIAL APPLICATION

The invention finds its application in the technical field of ironing appliances and processes.

What is claimed is:

1. Iron comprising a heating soleplate (2), a water supply system (7) for supplying water which is free of adjuvant, an adjuvant reservoir (15) for containing a textile adjuvant, and a device (11) for dispensing the adjuvant, said iron comprising adjuvant diluting means (7, 12, 14, 18, 20–23) connected to said adjuvant reservoir (15) and to said water supply system (7), for producing a diluted solution of the adjuvant before said dispensing, wherein said diluting means comprise a mixing chamber (18, 22) for mixing water coming from the water supply system and adjuvant coming from the adjuvant reservoir.

2. Iron according to claim 1 wherein the adjuvant is a liquid.

3. Iron according to claim 1, wherein the adjuvant is a solid, and said adjuvant reservoir is arranged to be loaded with adjuvant to a maximum concentration by a stream of water which traverses said adjuvant reservoir.

4. Iron according to claim 1, wherein the adjuvant is in a form selected from among: a solution; an emulsion; a suspension; and a latex.

5. Iron according to claim 1 wherein said adjuvant diluting means comprise a first pumping system (12) which draws water and adjuvant into said mixing chamber (18), and a second pumping system (14) which draws adjuvant from said adjuvant reservoir (15), said pumping systems having an average relative pumping flow rate in a predetermined dilution ratio.

6. Iron according to claim 5 wherein the adjuvant reservoir (15) comprises a spout (17) opening to the exterior of the iron.

7. Iron according to claim 1 wherein said diluting means (7, 20–23) comprise: a pump (22) having an inlet chamber which constitutes said mixing chamber; a first capillary tube (20) connected to draw water from said supply system (7); and a second capillary tube (21) connected to draw adjuvant from said adjuvant reservoir (15).

8. Iron according to claim 7 wherein said diluting means further comprise a tap (23) which permits blocking of adjuvant flow from said adjuvant reservoir to said second capillary tube.

9. Iron according to claim 1, further comprising a steaming device (4–10) fed by said water supply system (7).

10. Iron according to claim 1 wherein said adjuvant reservoir consists of a removable cassette.

11. Iron according to claim 1 wherein said water supply system comprises an adjuvant-free water reservoir.

* * * * *